US006468721B1

(12) United States Patent
Twist et al.

(10) Patent No.: US 6,468,721 B1
(45) Date of Patent: Oct. 22, 2002

(54) METHOD AND APPARATUS FOR PROCESSING PHOTOGRAPHIC MATERIAL

(75) Inventors: Peter J. Twist, Lee Common; Anthony Earle, Harrow Weald, both of (GB)

(73) Assignee: Eastman Kodak Company, Rochester, NY (US)

( * ) Notice: Subject to any disclaimer, the term of this patent is extended or adjusted under 35 U.S.C. 154(b) by 17 days.

(21) Appl. No.: 09/718,042

(22) Filed: Nov. 20, 2000

(30) Foreign Application Priority Data

Dec. 22, 1999 (GB) ..... 9930140

(51) Int. Cl.[7] ..... G03C 5/00; G03C 7/00

(52) U.S. Cl. ..... 430/403

(58) Field of Search ..... 430/403

(56) References Cited

U.S. PATENT DOCUMENTS

| | | | | |
|---|---|---|---|---|
| 3,461,787 | A | 8/1969 | Pfaff | 396/594 |
| 3,593,641 | A | 7/1971 | Adams et al. | 396/611 |
| 5,357,305 | A | 10/1994 | Long | 354/318 |
| 5,625,856 | A | 4/1997 | Kohda et al. | 396/604 |

FOREIGN PATENT DOCUMENTS

| | | |
|---|---|---|
| BE | 357195 | 2/1929 |
| GB | 1035085 | 7/1966 |

*Primary Examiner*—Hoa Van Le
(74) *Attorney, Agent, or Firm*—Frank Pincelli

(57) ABSTRACT

The method and apparatus supplies processing solution directly to the surface of a web of sensitized material by means of a movable applicator. The web and applicator are moved relative to each other to enable good mixing of the solution on the surface. The movable applicators can be moved in and out of contact with the material as required so that the process can be varied.

8 Claims, 7 Drawing Sheets

METHOD AND APPARATUS FOR PROCESSING PHOTOGRAPHIC MATERIAL

FIELD OF THE INVENTION

This invention relates to photographic processing and is more particularly concerned with the application of photographic processing solutions to the material to be processed.

BACKGROUND OF THE INVENTION

It is known to apply processing solutions to the material to be processed by passing the material through a number of tanks and reservoirs containing the required solutions. Such arrangements require large volumes of processing solutions in order to operate effectively. This means that the processing solutions used need to be stable for relatively long periods of time. It is also difficult to vary the process cycle.

To overcome the necessity of maintaining large tanks of relatively unstable solution further methods were developed in which the solutions are applied to the surface of the material being processed. In this method the processing chemicals required can be kept separately until just before they are needed.

It is an objective of the invention to provide satisfactory processing of color film or paper without the need for large tanks (2 liters or more) as used in conventional processing. This objective can be achieved by applying small volumes of processing solution directly to the surface of the photographic material. This method however has several attendant problems which must be solved in order to make such surface application practical. The problems found with surface application are that processing is not uniform if small volumes are used, processing is slow because there is no agitation after application of the solution and the chemical consumption is high because there is no mixing of the solution.

It is an object of the invention to provide a method and apparatus which overcome the problems mentioned above.

SUMMARY OF THE INVENTION

According to the present invention, there is provided a method of processing light sensitive material, the method comprising the steps of applying a fixed volume of processing solution to the surface of the material to be processed by means of at least one movable applicator and moving the applicator backwards and forwards along the length of the material to enable mixing of the solution on the surface, the at least one applicator being movable from a position in contact with the material to a position out of contact with the material such that the process cycle is variable.

The invention described overcomes the problems of the prior art and provides a practical surface application method. The method is called "dynamic surface application" in which mixing of the applied solution occurs during the whole process time.

The invention provides a method of high agitation while still providing good uniformity. It is particularly suitable for"single use" chemistry where the solution is not reused.

The method provides a process which can accommodate any process cycle. The process cycle can be varied almost instantly by changing the number of applicators for a given stage of the process by moving the applicators in and out of contact with the surface of the material being processed. More than one applicator can be used for each stage of the process or a single applicator can be used for all the solutions in the process. The method is equally applicable to film and paper and these materials can be processed in the same processor.

Both the solution and the web of material can be heated to a higher temperature than is possible using a large tank of solution. This allows more rapid processing to take place. Furthermore, since only small volumes of solution are required for each stage of the process unstable processing solutions may be used.

The above and other objects, features and advantages of the present invention will become apparent from the following description of preferred embodiments, in connection with the accompanying drawings.

DETAILED DESCRIPTION OF THE INVENTION

Figure 1A:
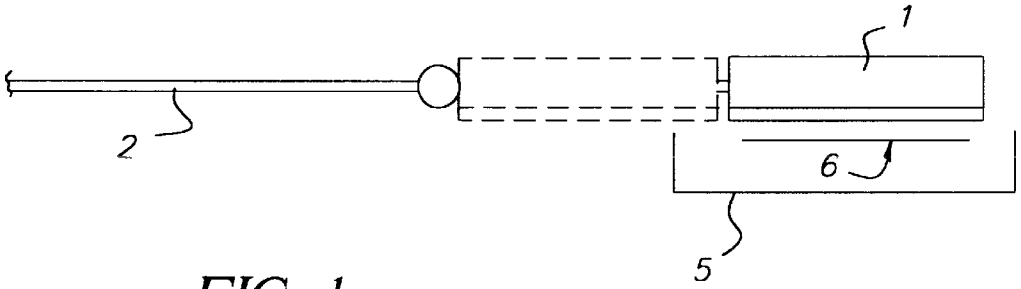
FIG. 1*a* is a schematic view of one method of moving the applicator member into and out of contact with the material.

FIG. 1*a* shows a schematic cross-sectional view of one method of moving the applicator member into and out of contact with the material.

A movable applicator head 1 is positioned in contact with a web of sensitized material 6 to be processed. The material may be film or paper. The applicator head 1 comprises a pad of absorbent material which is enclosed in a shell. The shell may enclose the whole pad with the exception of the front face, which is to contact the sensitized material. The pad may be made of any material which will not cause damage to the sensitized material, for example only, foam, sponge or felt. The shell may be made of a plastic material. In the embodiment illustrated a feed pipe 2 is in connection with the rear of the applicator head. The other end of the feed pipe is connected to a reservoir of processing solution, not shown. It is not essential that the solution is provided to the rear of the applicator head 1. The solution may be supplied to the pad by any suitable means, such as by dipping the pad in a reservoir of the solution. An overflow tray 5 is positioned below the web of material.

In operation, the applicator 1 is brought into contact with the surface of the sensitized material 6. The applicator 1 contacts the surface of the sensitized material across its width. In the embodiment illustrated, the processing solution is fed through the feed pipe 2 to the applicator from the reservoir. The applicator 1 supplies a controlled amount of processing solution to the surface of the material 6. The applicator moves backwards and forwards along the length of the material. The processing solutions are thus spread on the surface of the material and mixed so that seasoning effects are distributed in a manner similar to that of a conventional deep tank processor. The processing solution can be supplied either in concentrated single use form or in dilute form. Excess solution is collected in tray 5. The web of material 6 may be either stationary or moving during the process.

Figure 1B:
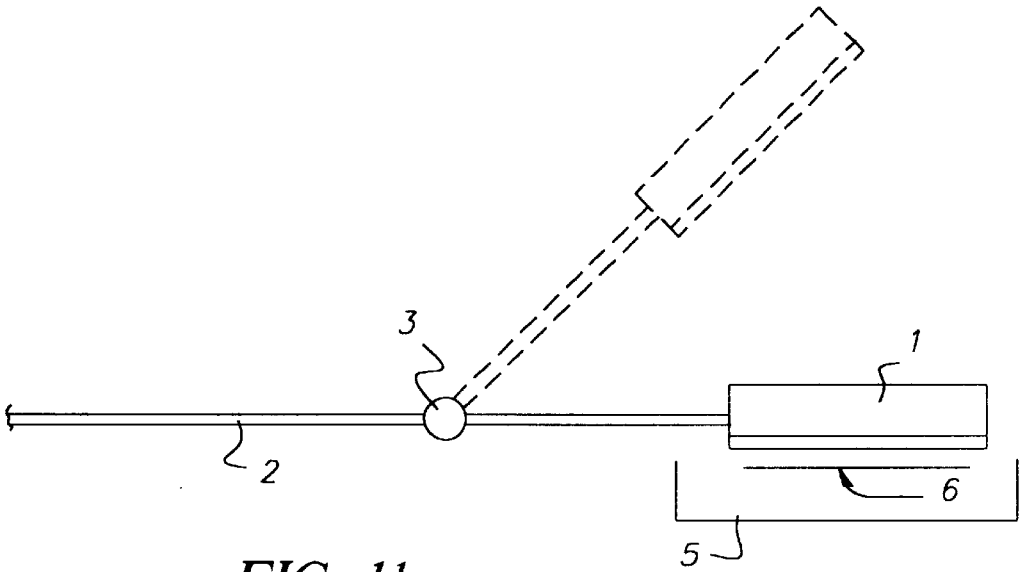
FIG. 1*b* is a schematic view of a second method of moving the applicator member into and out of contact with the material.

The applicator 1 is moved into and out of contact with the sensitized material 6 as required. In the embodiment shown in FIG. 1*a* the applicator head is retracted out of contact with material 6 to the position shown by dotted lines. FIG. 1*b* shows an applicator 1 which is moved out of contact with the material 6 by means of a hinge 3 to the position shown by dotted lines. These are just two examples and it will be understood by those skilled in the art that any suitable method of moving the applicator may be utilized.

Applicators 1 can be arranged in rows on either side of the web of material 6 with a separate applicator for each stage of the process. Alternatively there may be more than one applicator for each stage of the process. The solutions may be applied separately or in sequence. It is also envisaged that the same applicator 1 may be used for all the solutions required in the process.

Figure 2:
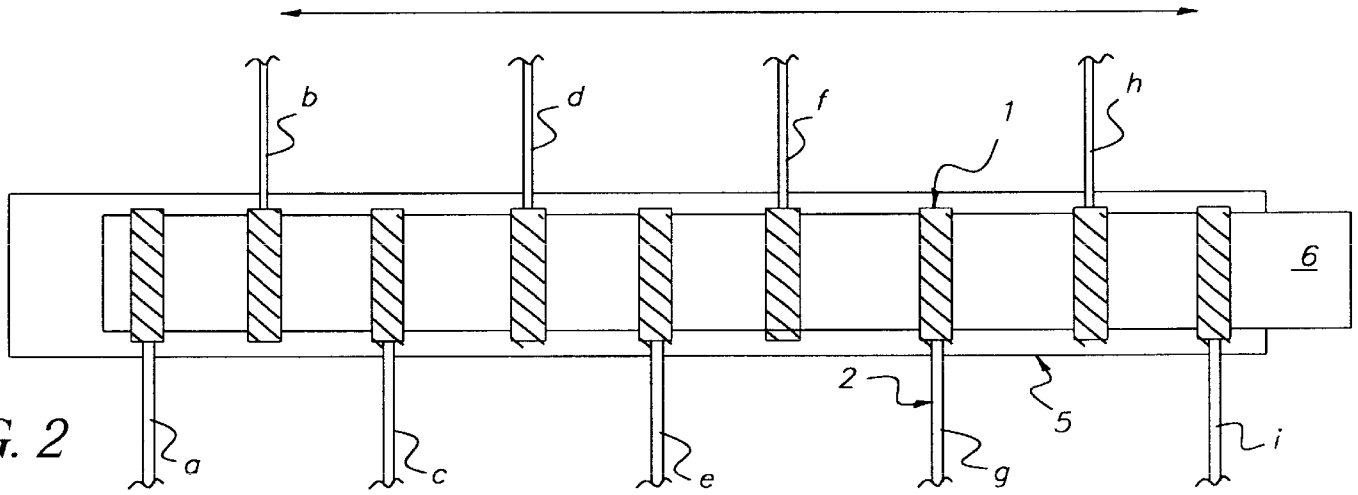
FIG. 2 is a schematic view of a first embodiment of the invention.

FIG. 2 illustrates a possible arrangement of applicators to effect various process cycles. In this embodiment, a plurality of applicators 1, a to i are arranged in series along the length of the material 6. Each applicator is supplied with processing solution as described above. The applicators may be supplied with the same or different processing solutions. For example, applicators a, b and c may be supplied with color developer solution, applicators d, e and f may be supplied with bleach-fix solution and applicators g, h and i may be supplied with stabilizer or wash solution. In this embodiment the web of material moves backwards and forwards as shown by the arrow over an overflow tray 5 as described above. The applicators are fixed and it is the backwards and forwards movement of the material which provides the required agitation and mixing.

To achieve good agitation and mixing the applicators should pass along the length of the web of material in contact with the surface of the material at a rate of between one length every five seconds to ten lengths per second. Preferably the rate is between one length every two seconds to five lengths per second. It has been found that the optimum rate to minimize seasoning effects is one sweep along the length of material per second. Of course it may be that the applicators are fixed and the web of material moves backwards and forwards as described above. If both the material and the applicators move the speed of the applicators should be faster or slower than the speed of the material.

There can be as many or as few applicator stages as required. Applicator stages can be skipped by moving the applicator heads out of contact with the material or spare applicators can be ready to bring into contact with the material. Therefore, it is possible to instantly change the process cycle or the entire process. Small changes can be made to the process cycle by adding or removing one or more applicators per stage in the process. Small changes in the development time for example, are very useful for improving the performance of certain films which might be marginal in the desired process. Thus, after a film type has been detected from its bar code, it is possible to fine-tune the sensitometry of the film instantly by resetting the applicator pattern.

Figure 3:
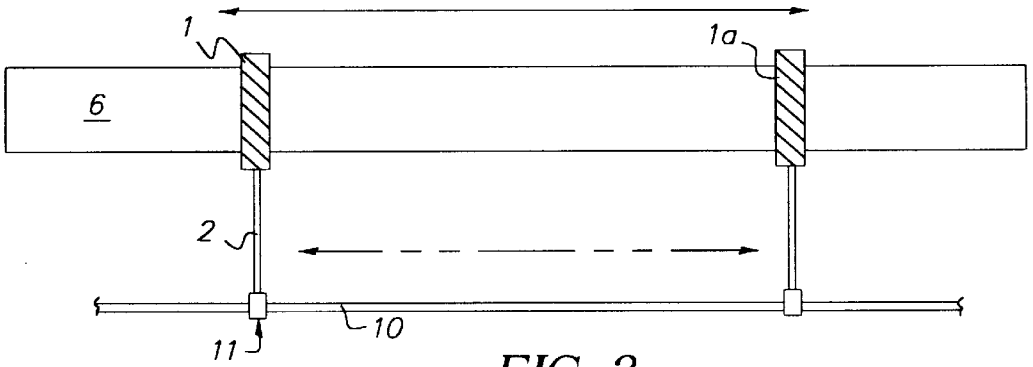
FIG. 3 is a schematic view of a second embodiment of the invention.

FIG. 3 illustrates an embodiment of the invention

The applicator illustrated in FIG. 3 is provided with a sliding collar 11, movable along a guide rail 10. The applicator can therefore be moved backwards and forwards to the position shown by dotted lines.

EXAMPLE 1

In this example Flexicolor C-41 developer replenisher LORR was applied to the surface of Kodacolor VR200 film using the method outlined as described with respect to FIG. 3. The film was placed on a heated metal block(37.8° C.) for the developer-replenisher stage for only 3 minutes 15 seconds and the rest of the process of bleach, fix and wash was completed as shown in the process cycle below. The volume of developer-replenisher used was 4 ml per linear foot (13 ml per linear meter) of 35 mm film. The same film was also processed in a deep tank sinkline C-41 reference process at 37.8° C. The process cycle was as follows.

| Process cycle | |
|---|---|
| Developer | 3 minutes 15 seconds |
| Bleach | 3 minutes 15 seconds |
| fix | 4 minutes 30 seconds |
| wash | 3 minutes |
| dry | in air |

where the developer is Flexicolor C-41 LORR, the bleach is Flexicolor Bleach III NR and the fix is Flexicolor C-41B fixer.

The results are shown in Table 1.

TABLE 1

Surface application compared with deep tank C-41

| | Process | | | | | | | | | | | |
|---|---|---|---|---|---|---|---|---|---|---|---|---|
| | Speed | | | Gamma | | | Dmin | | | Dmax | | |
| | R | G | B | R | G | B | R | G | B | R | G | B |
| C-41 reference | 340 | 350 | 357 | 0.66 | 0.74 | 0.86 | 0.16 | 0.45 | 0.70 | 1.73 | 2.17 | 2.7 |
| Surface method | 337 | 348 | 342 | 0.67 | 0.84 | 1.01 | 0.18 | 0.40 | 0.67 | 1.41 | 1.86 | 2.4 |

It can be seen that speed, Gamma and Dmin are quite close to the reference process but Dmax is slightly low of aim which is due to seasoning products from the film. This demonstrates the principle of the method and indicates that a slight reformulation of the developer replenisher composition is necessary to compensate for the low Dmax.

EXAMPLE 2

In this example the method is used to apply a processing solution which is relatively unstable in its mixed state but will allow very rapid processing. The processing solution is made just prior to processing by mixing two stable parts together. The processing solution is employed in the form of a"single-use mode" and was applied to the film surface by the method outlined as described with respect to FIG. 3. Thus the solution for processing in a particular stage or part of a stage is contained entirely in the porous applicator. A developer formula shown in Table 2 was used.

TABLE 2

| Developer composition | |
|---|---|
| Component | Concentration |
| $Na_3PO_4.12H_20$ | 50 g/l |
| IPSHA | 10 g/l |
| CD4 | 10 g/l |
| KBr | 8 g/l |
| KOH | 11.5 g/l |
| pH | 13.2 |
| Tween 80 | 10 drops/l |

where IPSHA is N-iso-propyl-N-sulfoethyl hydroxylamine, CD4 is 4-amino-3-methyl-N-ethyl-N-(hydroxyethyl)aniline sulphate and Tween 80 is a commercially available surfactant.

This can be made by mixing all the components except the CD4 as part A with CD4 as part B.

| Component | Part A | Part B |
|---|---|---|
| $Na_3PO_4$ | 52 g/l | — |
| IPSHA | 10.4 g/l | — |
| CD4 | — | 250 g/l |
| $K_2SO_3$ | — | 13 g/l |
| KBr | 8.3 g/l | — |
| KOH | 12.0 g/l | — |
| pH | 13.3 | — |
| Tween 80 | 10 drops/l | — |

where 4 ml of Part B is added to 100 ml of Part A.

It is also possible to make a concentrated form of Part A and then add Parts A and B to water.

A color negative film (No. 1) was laid on a heated block (50° C.) with the emulsion side face-up and developer solution was applied by means of a porous applicator. A known volume of developer solution (2 ml per linear foot or 6.6 ml per linear meter of 35 mm film) was metered onto the porous applicator before it was used and both the developer solution and the applicator were unheated. The porous applicator was applied to one end of the film and was moved backwards and forwards at 1 cycle per second to spread the solution along the entire length of the film. The porous applicator head consisted of foam covered with very fine mohair. The porous applicator releases solution when squeezed and so the pressure on it was controlled by means of adjustable height guides on which the applicator moved. After the development time was completed a second porous applicator with an acetic acid solution which stopped development was used and subsequently the film strip was bleached and fixed in a normal processing tank using C-41 bleach and fix and then washed for two minutes. The developer solution and the porous applicator were designed for rapid processing and the results for a 15 second development time are shown in FIG. 4.

Figure 4:
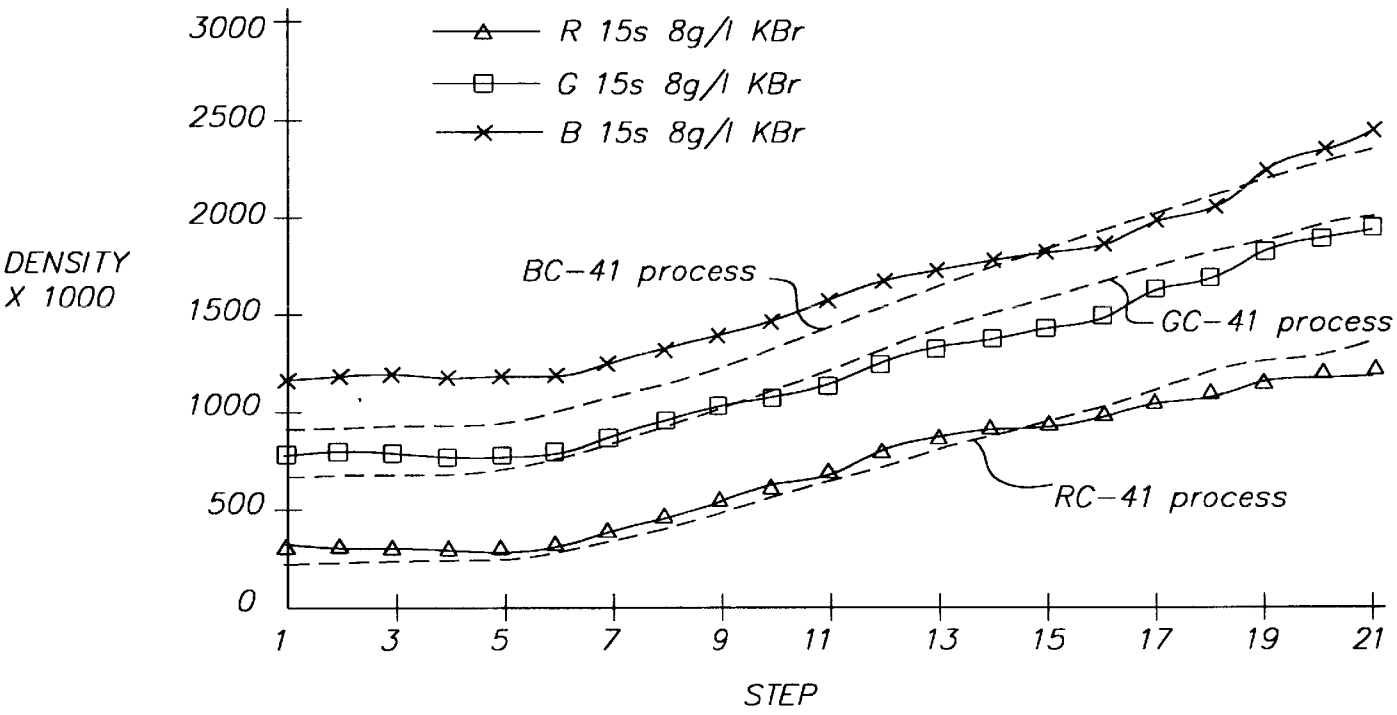
FIG. 4 is a graph showing the results of a second example of the invention.

In FIG. 4 it can be seen that there is a quite close sensitometric match between the C-41 process with a development time of 195 seconds and the rapid process with a development time of 15 seconds. A number of advantages arise from the method:

The invention allows a considerable shortening of development time compared with the reference process.

The method allows the use of a developer formulation which is not very stable if left in a processing tank but in the invention the developer is made just before use from stable concentrates and so stability is no longer a concern. This is not possible in a deep-tank processor because of the relatively large volume (for example, the smallest Kodak SM minilab has a developer tank of 3.5 liters) involved and the considerable waste if a tank has to be dumped.

The small volume used per unit length of film (6.6 ml per linear meter) in the method of the invention is in fact lower than the volume of replenisher 12.87 ml per linear meter; ("Using Kodak SM Chemicals in SM Minilabs") used in a conventional deep-tank minilab processing machine for the same amount of film.

EXAMPLE 3

In this example, color paper (Ektacolor Edge 7) was processed using the porous applicator. The complete process was carried-out using porous applicators for each stage and the process cycle was as follows.

| Process cycle | |
|---|---|
| Develop | 10 seconds |
| Bleach-fix | 10 seconds |
| Wash | 4 × 5 seconds |

The paper strips (1 ft), approximately 30.5 mm, were placed on a heated block (55 ° C.) and the developer solution was metered onto the applicator at 2 ml/ft or 6.6 ml/meter. The porous applicator was moved over the paper at 1 cycle per second and both the developer solution and the applicator were unheated.

The developer composition used is shown in Table 3.

TABLE 3

| Developer composition | |
|---|---|
| K2CO3 | 33 g/l |
| IPSHA | 10 g/l |
| CD3 | 10 g/l |
| REU | 2 g/l |
| Tween 80 | 10 drops |
| pH | 10.6 |

where IPSHA is isopropyl sulphoethyl hydroxylamine. REU is Phorwite REU a commercially available optical brightener. CD3 is N-[2-(4-amino-N-ethyl-m-toluidino)ethyl]-methanesulphonamide sesquisulphate hydrate.

Figure 5:
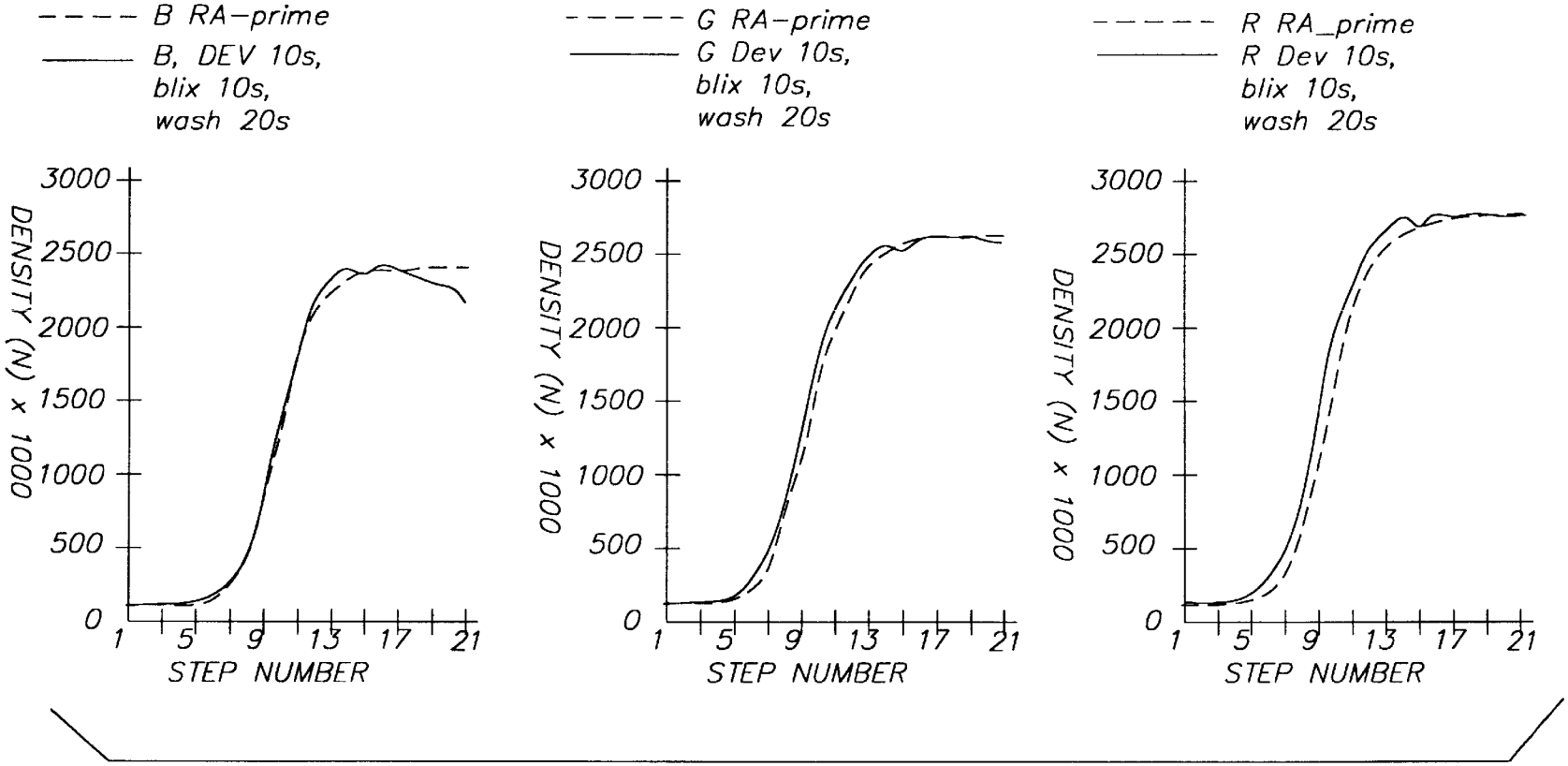
FIG. 5 is a graph showing the results of a third example of the invention.

The bleach-fix used was Ektacolor Pro Bleach-fix replenisher. The wash consisted of four applicators which were immersed for 5 seconds in wash-water at 80° C. and then applied to the paper surface in sequence for a total wash-time of 20 seconds. The result is shown in FIG. 5.

It can be seen that there is a close match of the sensitometry for the paper processed with the porous applicator with that of the reference process RA-Prime. The total process time for RA-Prime is 180 seconds and the total process time for the porous applicator is 40 seconds.

EXAMPLE 4

In this example low silver color paper containing 8 mg/sq.ft (86 mg/sq.m) was processed in an RX or amplification method using the porous applicator. Conventional color paper has about 50 to 60 mg/sq. ft (530 to 645 mg/sq.m). The processing solution compositions are shown in Table 4.

TABLE 4

| Processing solution composition | |
|---|---|
| Developer Composition | |
| KOH (solid) | 20 g/l |
| IPSHA (solid) | 10 g/l |
| CD3 (solid) | 10 g/l |
| Photoflow | 2.5 ml/l |
| Amplifier Composition | |
| H2O2 (30%) | 20 ml/l |
| Photoflow | 2.5 ml/l |
| Fixer composition | |
| Na2SO3 | 50 g/l |

1 ml of a particular solution was pipetted onto the porous applicator and spread evenly over the pad by rolling the pipette over the surface. The pad was then applied to the surface of the paper which was clipped to the surface of a level coating block. The paint pad was moved at 1–2 cps backwards and forwards over the paper surface. The developer was applied first then the amplifier with a separate applicator for each solution. The fixer was in a 500 ml measuring cylinder. Fixing was for 2 minutes. Strips were then washed for 3 minutes.

| Strip Number | Details |
|---|---|
| 1 | 15 sec developer (1 ml) no amplifier (23° C.) |
| 2 | 15 sec developer (1 ml), then 20 sec amplifier (1 ml) (23° C.) |

Results

| | Dmax Density × 100 | | | Dmin Density × 100 | | |
|---|---|---|---|---|---|---|
| Strip number | R | G | B | R | G | B |
| 1 | 63 | 66 | 71 | 9.8 | 11.2 | 10.5 |
| 2 | 243 | 200 | 138 | 10.9 | 12.2 | 11.2 |

The results show that amplification has occurred compared with a strip not treated with the amplifier. The blue Dmax density is low which indicates that further formula optimization is needed or a higher temperature is needed.

Figure 6:
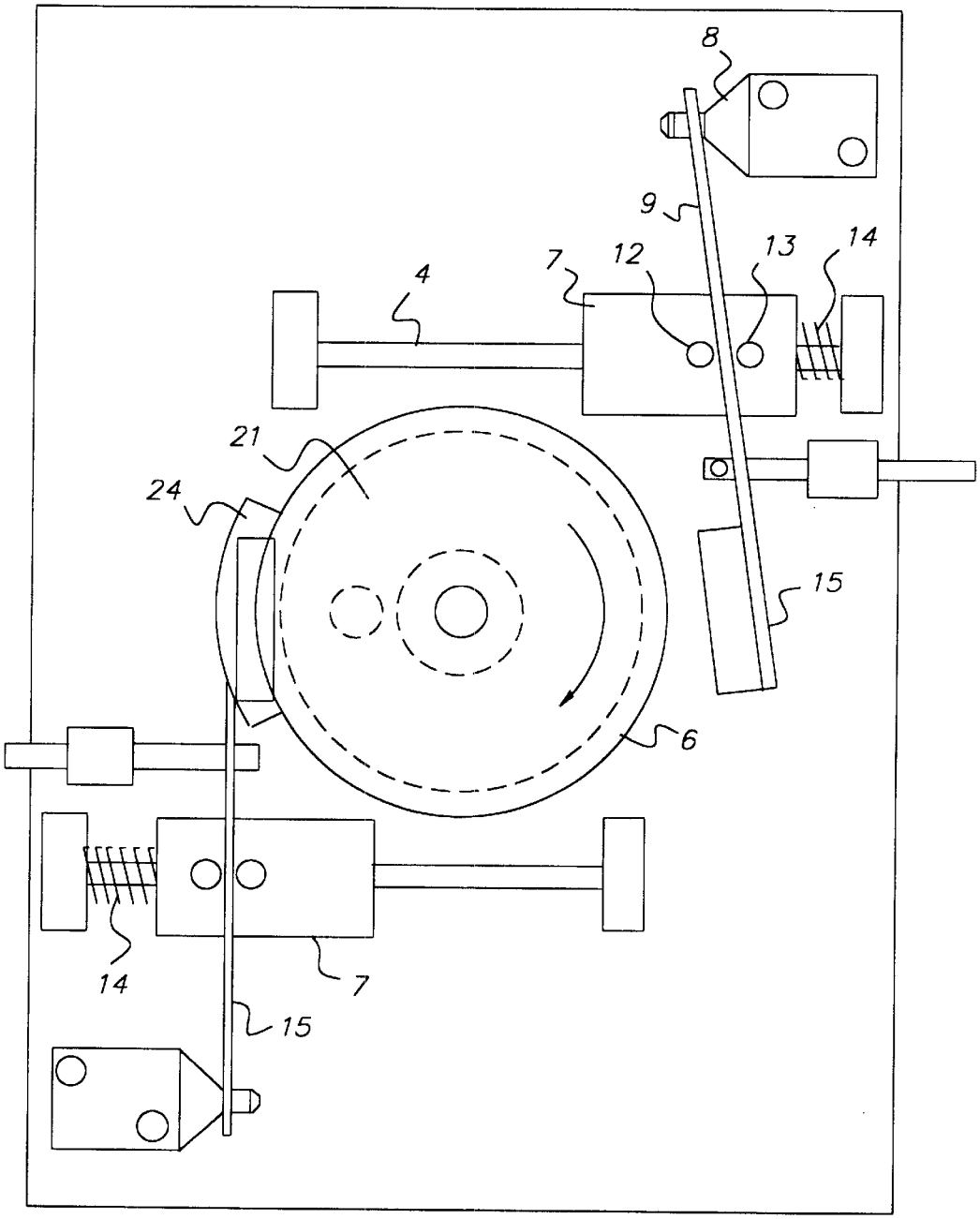
FIG. 6 is a schematic view of a third method of moving the applicator member into and out of contact with the material.
Figure 7:
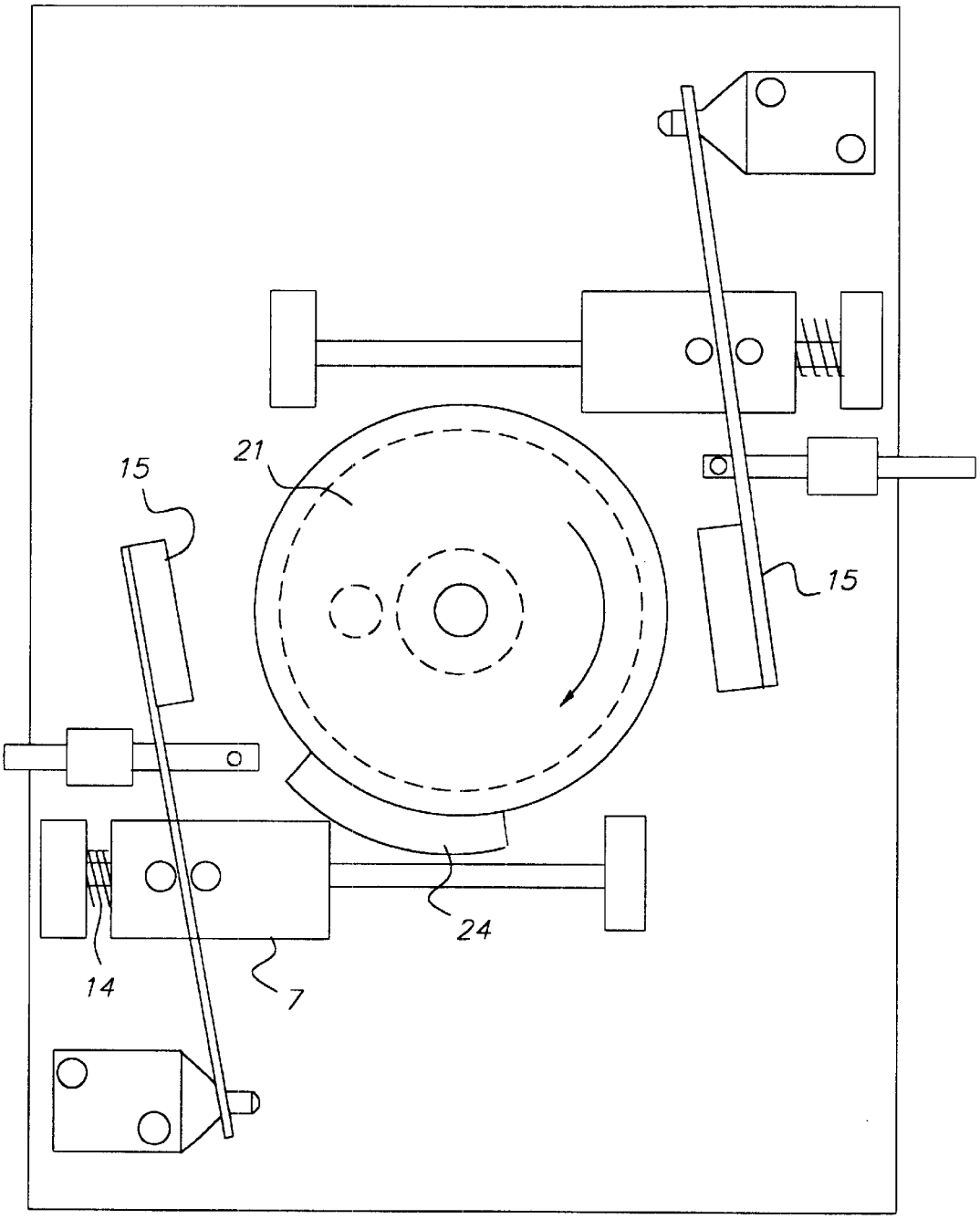
FIG. 7 is a schematic view of a fourth method of moving the applicator member into and out of contact with the material.

FIGS. 6, 7 and 8 illustrate further embodiments of the invention in which the web of material follows a rotary path.

In this embodiment the material 6 is wrapped around and carried on a bobbin 21. The material, in this example film, is attached to the bobbin 21 and is rotated with it. The bobbin includes a cam 24. Two applicators 15 are shown, for applying two different solutions. Each applicator 15 is carried on a carriage 7. The relative pressure of the applicator on the film is controlled by the carriage 7 which has locating pins 12 and 13 running on a guide rail 4 under the action of a spring 14. Each applicator 15 is located by means of a bracket with a pin 8 which passes through a locating hole of the applicator shaft 9. The applicator can easily be removed or changed by lifting the pin. The applicators can be withdrawn or engaged on demand by, for example, use of an electrically operated mechanism.

As the bobbin 21 and film 6 rotate, the cam 24 pushes on carriage 7 and lifts the applicator 15 clear of the ends of the film and attachment means and thus avoids damage to the film and uneven processing. This is shown in FIG. 7.

The applicator 15 being pushed clear of the bobbin 21 by the cam 24 pushing the carriage 7 back against the spring 16. The carriage cannot return the applicator to its working position until the cam is clear.

It will be understood that a plurality of applicators may be accommodated by the enlargement of the diameter of the bobbin 21.

Figure 8B:
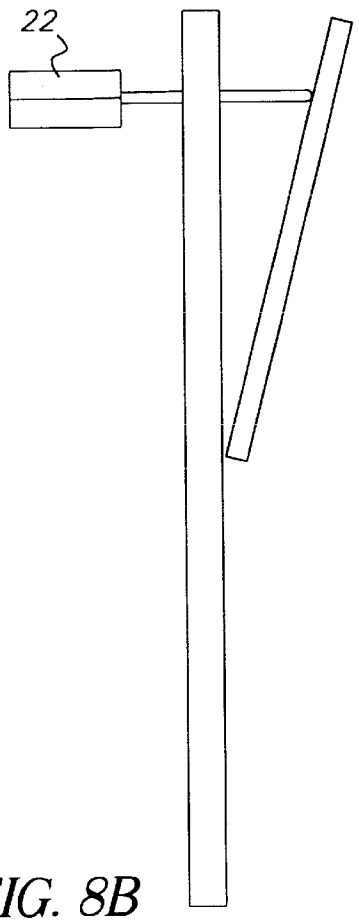
FIG. 8*b* is a side view of a number of applicators for use with the invention.
Figure 8A:
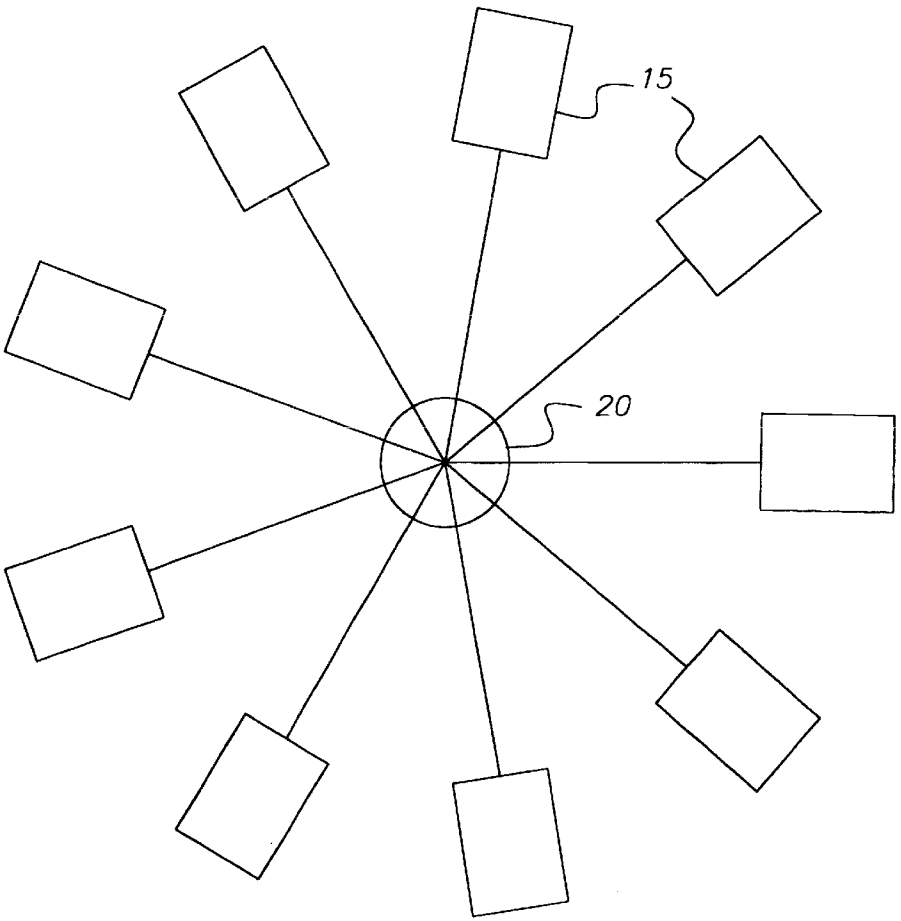
FIG. 8*a* is a schematic plan view of a number of applicators for use with the invention.

FIGS. 8*a* and 8*b* illustrate how a plurality of applicators 15 may be attached to a central hub 20 for easy storage and selection. FIG. 8*a* shows a plan view of a plurality of applicators for selection. Each applicator is attached to the end of an arm, the other end of which is attached to the central hub, all lying within the same plane. As each applicator is required, an actuator 22 simply pushes it out of the plane into contact with the surface of the material to be processed, as shown in FIG. 8*b*.

As can be understood from the detailed description, the present invention provides a method of processing in which good mixing of a limited amount of processing solution is achieved. It is particularly suitable for"single use" chemistry where the solution is not reused. The process cycle can be varied almost instantly by changing the number of applicators for a given stage of the process by moving the applicators in and out of contact with the surface of the web of material being processed. The process cycle can be changed any combination of times consistent with completing the process.

The invention is particularly applicable to"single" use application where a fixed volume of solution is applied to the surface of the material. By moving the applicator backwards and forwards along the length of the material good agitation is provided at the same time as good uniformity. The method can be used for paper and film processing in a single processor. The method can be used for any stage in a process cycle, for color, black and white and reversal processing. The method can also be used in RX amplification or intensification processing.

The present invention has been described in detail with reference to preferred embodiments. It will be understood by those skilled in the art that variations and modifications may be effected within the scope of the invention.

Parts List

1. applicator head
2. feed pipe
3. hinge
4. guide rail
5. overflow tray
6. web of material
7. carriage
8. pin
9. applicator shaft

10. guide rail
11. sliding collar
12. locating pin
13. locating pin
14. spring
15. applicator
16. spring
20. hub
21. bobbin
22. actuator
24. cam

What is claimed is:

1. A method of processing light sensitive material, the method comprising the steps of applying a fixed volume of processing solution to the surface of the material to be processed by means of at least one movable applicator and moving the applicator backwards and forwards along the length of the material to enable mixing of the solution on the surface, the at least one applicator being movable from a position in contact with the material to a position out of contact with the material such that the process cycle is variable.

2. A method as claimed in claim 1 wherein the applicator moves along the length of the material at a speed ranging from one length every five seconds to ten lengths per second.

3. A method as claimed in claim 2 wherein the applicator moves along the length of the material at a speed ranging from one length every two seconds to five lengths per second.

4. A method as claimed in claim 3 wherein the applicator moves along the length of the material at a speed of one length per second.

5. A method as claimed in claim 1 wherein the applicator is moved into and out of contact with the material by extension and retraction means.

6. A method according to claim 1 wherein the applicator is moved into and out of contact with the material by hinge means.

7. A method as claimed in claim 1 wherein the web of material is moved in a rotary manner.

8. A method as claimed in claim 1 wherein the processing solution supplied to the at least one applicator is changed in a predetermined sequence throughout the process cycle.

* * * * *